US008403446B2

(12) United States Patent
Ohara

(10) Patent No.: US 8,403,446 B2
(45) Date of Patent: Mar. 26, 2013

(54) PRINTING APPARATUS AND CONTROL METHOD THEREOF

(75) Inventor: Midori Ohara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 466 days.

(21) Appl. No.: 12/834,217

(22) Filed: Jul. 12, 2010

(65) Prior Publication Data

US 2011/0018925 A1 Jan. 27, 2011

(30) Foreign Application Priority Data

Jul. 23, 2009 (JP) ..... 2009-172438
Jun. 7, 2010 (JP) ..... 2010-130167

(51) Int. Cl.
*B41J 29/38* (2006.01)

(52) U.S. Cl. ..... 347/14; 347/103; 347/104

(58) Field of Classification Search ..... 347/14, 347/103, 104
See application file for complete search history.

(56) References Cited

U.S. PATENT DOCUMENTS

2001/0022607 A1* 9/2001 Takahashi et al. ..... 347/103
2007/0126836 A1* 6/2007 Masuyama et al. ..... 347/103
2010/0060703 A1* 3/2010 Ohara et al. ..... 347/102

FOREIGN PATENT DOCUMENTS

JP 2007-022082 A 2/2007

* cited by examiner

*Primary Examiner* — Laura Martin
(74) *Attorney, Agent, or Firm* — Fitzpatrick, Cella, Harper & Scinto

(57) ABSTRACT

A printing apparatus and control method thereof are provided that make it possible to recycle or replace an intermediate transfer member at optimal timing through early detection of changes in a surface characteristic of the intermediate transfer member, and make it possible to create high quality printed materials with good productivity. An application amount of reaction solution applied to the surface of the intermediate transfer member is detected, and notification is given of a comparison result when that detected application amount of reaction solution is compared with a specified threshold value.

13 Claims, 5 Drawing Sheets

PRINTING APPARATUS AND CONTROL METHOD THEREOF

BACKGROUND OF THE INVENTION

1. Field of the Invention

The present invention relates to a printing apparatus that prints an image by transferring an ink image formed on an intermediate transfer member to a printing medium, and to a control method of that printing apparatus.

2. Description of the Related Art

An inkjet printing method using an inkjet ejection apparatus used widely by consumers is also used industrially, and its application is expected to increase even further. One of the application areas is the printing field. When such an inkjet printing method is applied to the field of printing, there is no need for a printing plate as was necessary in conventional printing methods such as offset printing, and because the lead time is extremely short, it is possible to quickly obtain the desired printed materials. These features are gaining attention as preferred technology for meeting the present needs of multiple products, small lots and short delivery time.

However, in an inkjet printing method that uses such an inkjet ejection apparatus, there is a possibility of a decrease in image quality due to certain unique phenomena. One of the phenomena is called the "bleeding" phenomenon and other one is called the "beading" phenomenon. Bleeding is a phenomenon in which when ink is directly applied to a printing medium such as paper having a flat smooth surface using an inkjet ejection apparatus, the ink is not completely absorbed by the paper and some remains on the surface of the paper, so adjacent inks that have been applied to the paper mix with each other. Beading is a phenomenon in which ink that is applied to the paper first is drawn in by ink that is applied to the paper later, which leads to the possibility of a decrease in the printing quality of the image and may cause poor drying of the paper.

In order to reduce such phenomena, a method has been proposed (transfer type inkjet printing method) in which an ink image is formed on an intermediate transfer member by the inkjet ejection apparatus, and that ink image is then transferred onto a printing medium. Moreover, a technique has been proposed in which in order to transfer an ink image that is on an intermediate transfer member to a printing medium without a decrease in the image quality, the intermediate transfer member is coated with a coating solution. This coating solution is generally called a reaction solution, with a reaction component that lowers the fluidity of the coloring material in the ink. When this reaction solution comes in contact with ink on the intermediate transfer member, the fluidity of the coloring material instantly decreases due to the function of the reaction component in the solution, and distortion of the ink image being suppressed.

However, in this kind of transfer type inkjet printing method, when images are printed continuously, the characteristics of the surface of the intermediate transfer member changes and the reaction solution ceases to perform its function properly. Such a situation may lead to distortion of the image and decrease in image quality. Therefore, it is necessary to periodically replace or recycle the intermediate transfer member, and it is preferable that the replacement period or the recycle period be appropriately set. That is because, when the replacement or recycle is performed too late, there is an increased possibility that images will be produced having poor image quality, and conversely, when the replacement or recycle is performed too early, the intermediate transfer member will be replaced unnecessarily, which is disadvantageous from the aspect of productivity and cost.

In Japanese Patent Laid-Open No. 2007-022082, a transfer surface maintenance system monitoring method is disclosed as a method of appropriately setting the replacement period for replacing the intermediate transfer member. In other words, first, an ink image of a test pattern is formed on the intermediate transfer member, and that ink image is captured by an image detector to acquire a printed pattern response. Next, using the transfer surface maintenance system, the intermediate transfer member is cleaned after which the image remaining on the intermediate transfer member is captured by the image detector to acquire a cleaned image response. The printed pattern response and cleaned image response are then compared to calculate the cleaning efficiency, and by comparing the calculated result with a specified limit, whether or not there is problem with the intermediate transfer member is determined. When it is determined that there is a problem with the intermediate transfer member, a correction process is executed.

The method disclosed in Japanese Patent Laid-Open No. 2007-022082 determines whether or not there is a problem with the intermediate transfer member by comparing the test pattern formed on the intermediate transfer member and the cleaned image response, and based on that information, sets the period for replacing or recycling the intermediate transfer member.

However, this method presumes that the surface of the intermediate transfer member when forming the test pattern is proper, so it is difficult to apply this method to a case in which the characteristics of the surface of the intermediate transfer member change greatly, and the test pattern cannot be formed properly. In addition, in this method, it is necessary to form a test pattern that cannot be used in production, and while forming that test pattern, there is a possibility that the original printing process will be disrupted. Furthermore, in this method, there is also a large problem in that it is not possible to detect the period for replacing or recycling the intermediate transfer member beforehand, so there is a possibility that images will be formed with poor image quality.

SUMMARY OF THE INVENTION

The object of the present invention is to provide a printing apparatus and control method thereof that make it possible to recycle or replace the intermediate transfer member at optimal timing through early detection of changes in the surface characteristics of the intermediate transfer member, and make it possible to create high quality printed materials with good productivity.

The present invention is based on the following knowledge.

A change in the surface characteristics of the intermediate transfer medium on which an ink image is repeatedly formed is caused by a combination of changes, including chemical change and change in shape, however, it is extremely difficult to distinguish between these changes as well as directly detect and measure them. However, in actuality it is not necessary to detect and measure these changes in detail, and it is enough to determine whether or not the quality of the finally formed image is affected.

The inventors found that there is a very distinct connection between the change in the amount of reaction component of reaction solution that is applied to the intermediate transfer member and the effect on the image quality of the finally printed image. When a disturbance, such as evaporation of solvent of the reaction solution, occurs after the reaction solution is applied to the intermediate transfer member and before the amount of reaction component is measured, there is a very small fluctuation in the amount of reaction component due to that disturbance. Therefore, based on the amount of reaction component, it is possible to accurately determine the effect of the change in surface characteristics of the intermediate transfer member on the quality of the printed image.

It is important to note here that by measuring and evaluating the change in the amount of reaction component, it is possible to detect symptoms before there is a substantial decrease in image quality of the printed image.

In other words, in a printing method that forms an ink image on an intermediate transfer member after applying reaction solution to the intermediate transfer member, and then transfers that ink image to a printing medium, at the same time that surface characteristics of the intermediate transfer member begin to change, the amount of reaction component per unit area of the reaction solution applied to the intermediate transfer member begins to fluctuate. As the amount of reaction component fluctuates, a drop in the quality of the printed image occurs. However, the degree of the decrease in quality of the printed image is extremely small when compared with the degree of fluctuation of the amount of reaction component. Therefore, at the stage when the amount of reaction component is measured, and "even though there is fluctuation in the amount of reaction component, the distortion in the image is not noticeable", suitable operation of the intermediate transfer member is possible by performing a recycle process or replacement process for the intermediate transfer member.

Fluctuation of the amount of reaction component could be either an increase or a decrease that occurs over time. Therefore, it is preferable that the period for performing the recycling process or replacement process for the intermediate transfer member be determined by setting in advance an upper limit value and a lower limit value for the amount of reaction solution in the stage when distortion in the image is ignorable, and comparing a measured value of the amount of reaction solution with those values. Moreover, a method of measuring the electric conductivity is very suitable as a method for measuring the amount of reaction component, and with that measurement method, the amount of reaction component can be measured very easily, so that it is possible to keep adverse effect of the measurement process on the productivity of printed materials to a minimum.

In this way, as a result of dedicated investigation, the inventors found that in order to properly determine the period for replacing or recycling the intermediate transfer member, focusing on the amount of reaction component in the reaction solution applied to the intermediate transfer member was extremely effective.

In the first aspect of the present invention, there is provided a printing apparatus having an image formation unit that forms an ink image on a surface of an intermediate transfer member, and a transfer unit that transfers the ink image formed on the intermediate transfer member to a printing medium, comprising: an application unit configured to apply reaction solution reacting with ink to the surface of the intermediate transfer member; a detection unit configured to detect an application amount of the reaction solution applied to the surface of the intermediate transfer member by the application unit; and a notification unit configured to give notification of a comparison result when the application amount of the reaction solution detected by the detection unit is compared with a specified threshold value.

In the second aspect of the present invention, there is provided a printing apparatus having an image formation unit that forms an ink image on a surface of an intermediate transfer member, and a transfer unit that transfers the ink image formed on the intermediate transfer member to a printing medium, comprising: an application unit configured to apply reaction solution reacting with ink to the surface of the intermediate transfer member; a detection unit configured to detect an application amount of the reaction solution applied to the surface of the intermediate transfer member by the application unit; and an execution unit configured to execute at least one of a recycling process for the intermediate transfer member and giving notification of a replacement process for the intermediate transfer member, based on a comparison result when the application amount of the reaction solution detected by the detection unit is compared with a specified threshold value.

In the third aspect of the present invention, there is provided a control method for controlling a printing apparatus having an image formation unit that forms an ink image on a surface of an intermediate transfer member, and a transfer unit that transfers the ink image formed on the intermediate transfer member to a printing medium, comprising the steps of: applying reaction solution reacting with ink to the surface of the intermediate transfer member; detecting an application amount of the reaction solution applied to the surface of the intermediate transfer member; and giving notification of a comparison result when the detected application amount of the reaction solution is compared with a specified threshold value.

With the present invention, the change in the amount of reaction solution applied is correlated with the change in the surface characteristics of the intermediate transfer member, and by detecting the amount of reaction solution applied, it is possible to detect early any change in the surface characteristics of the intermediate transfer member before large changes appear in the printed image, and it possible to recycle or replace the intermediate transfer member at an optimal time. As a result, it is possible to produce high-quality printed materials with high productivity.

Moreover, the intermediate transfer member can be sufficiently used during the proper life thereof, which contributes to a reduction in production costs of printed materials. In addition, it is possible to recycle or replace the intermediate transfer member at a minimum frequency, so it is possible to reduce downtime of the printing apparatus and improve productivity of printed materials. Furthermore, it is possible to perform this kind of recycling process or replacement of the intermediate transfer member before the printed image degrades substantially, and it is possible to greatly reduce problems that occur when a mistake is made in performing these processes, or in other words, it is possible to greatly reduce the possibility of producing printed materials having poor image quality. It is also possible to suppress the amount of wasteful use of paper (as the printing medium) and ink, which is economically and environmentally advantageous.

Further features of the present invention will become apparent from the following description of exemplary embodiments (with reference to the attached drawings).

DESCRIPTION OF THE EMBODIMENTS

The embodiments of the invention will be explained below with reference to the accompanying drawings.

(Example of Construction of the Printing Apparatus)

Figure 1:
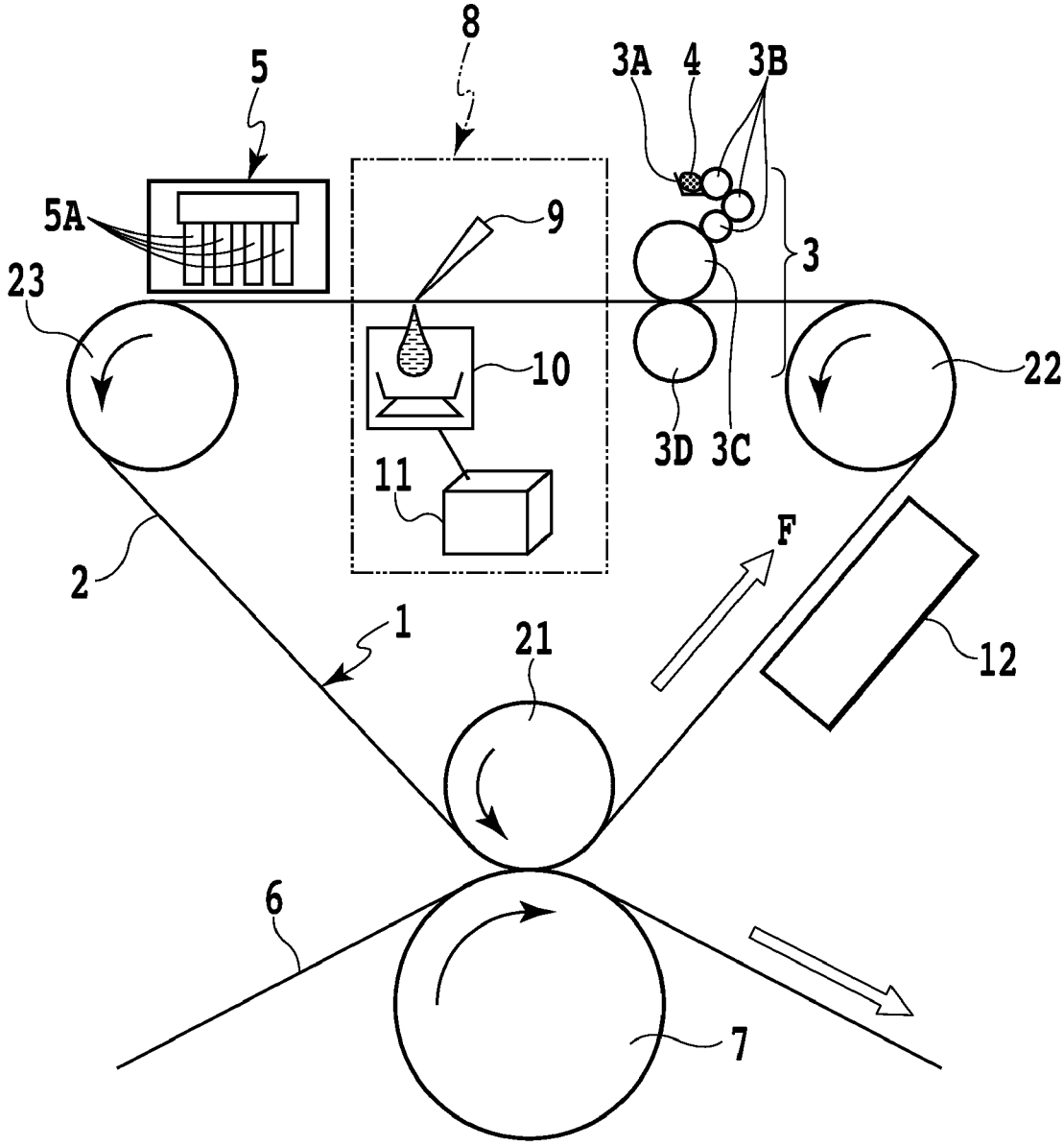
FIG. 1 is a schematic diagram for explaining the main parts of an example of the construction of the image printing apparatus of the present invention.

FIG. 1 is a schematic diagram for explaining the main parts of an example of the construction of the printing apparatus of the present invention.

In FIG. 1, a reference number 1 denotes a belt shaped intermediate transfer member (intermediate transfer belt), and on the surface thereof is a surface layer 2 on which an ink image is formed. The intermediate transfer belt (hereafter, also referred to as simply the "belt") 1 extends between rollers 21, 22 and 23 and moves in the direction of arrow F, and an ink image is formed on the surface layer 2 thereof after reaction solution has been applied.

A conventional intermediate transfer member such as the belt type member used in this example, or a drum type member can be used as the intermediate transfer member. Moreover, the material and construction of the intermediate transfer member is not particularly limited; for example, the intermediate transfer member may be a layered member that includes a support member (corresponds to the "base material of the belt 1"), and a surface layer (corresponds to the "surface layer 2") on which an ink image is formed after reaction solution has been applied. A conventional material such as metal, resin, rubber or ceramic can be used as the surface layer 2; for example, the surface layer 2 could be a water resistant material that has been made hydrophilic by treating the surface thereof. In that case, the surface treatment could be a treatment such as corona treatment, frame processing, active energy ray irradiation, plasma treatment and the like. In order to improve the effect of that surface treatment, gas, such as oxygen, could be used simultaneously. Silicon rubber and fluoro-rubber can be preferably used as the water resistant material. In addition, the surface layer (corresponds to the "surface layer 2") could be a plurality of overlapping layers. The surface layer can be formed such that it extends around the entire perimeter such as the belt 1 of this example, or could be formed such that it is divided into sizes that correspond to the printing medium (for example A4 size). In the case of the latter, by providing a mechanism for attaching or removing the printing medium to the surface layer in one sheet units, it is possible to lessen the cost and time required for recycling or replacing the intermediate transfer member.

The reaction solution 4 is applied to the surface layer 2 of the belt 1 by a contact-type application device 3 that is arranged such that it comes in contact with the belt 1. In this embodiment, the reaction solution 4 is supplied from a supply portion 3A to the surface of an application roller 3C by way of a plurality of rollers 3B. The reaction solution 4 is applied to the surface layer 2 by the application roller 3C coming in contact with the surface layer 2. A reference number 3D denotes a support roller that faces the application roller 3C with the belt 1 in between.

The reaction component included in the reaction solution 4 can be suitably selected according to the type of ink used for printing the image. For example, in the case of using a dye-based ink, using a high-polymer coagulant as the reaction component is effective, and in the case of using a pigment ink in which fine particles are dispersed, using metal ions as the reaction component is effective. Furthermore, in the case of using dye-based ink, it is also possible to use a combination of metal ions and a high-polymer coagulant as the image fixing component. In that case, pigment that is the same color as the dye material is mixed in the ink, and preferably white or transparent fine particles that have little effect on the color of the printed image is mixed in.

A cationic high-polymer coagulant, an anionic high-polymer coagulant, nonionic high-polymer coagulant, or dipolar high-polymer coagulant, for example, could be used as the reactant component. Particularly, in the case of using a cationic or anionic high-polymer coagulant or a dipolar high-polymer coagulant, it is possible to very accurately estimate the amount of reaction component from their electrical conductivity with the reaction component. Moreover, a bivalent metal ion such as $Ca^{2+}$, $Cu^{2+}$, $Ni^{2+}$, $Mg^{2+}$ and $Zn^{2+}$, or a trivalent metal ion such as $Fe^{3+}$ and $Al^{3+}$ can be used as the metal ion. When a reaction solution including these metal ions is applied to the intermediate transfer member, it is preferred that the reaction solution be used as metallic salt solution because of its handleability. It is possible to use $Cl^-$, $NO_3^-$, $SO_4^{2-}$, $I^-$, $Br^-$, $ClO_3^-$, or $RCOO^-$ (R is an alkyl group) as the anionic ion of the metallic salt. Moreover, it is also possible to use a material that is opposite of the ink that is used. For example, when the ink is anionic or alkaline, an opposite material such as a cationic or acidic material can be used as the reaction solution.

In order to improve the fastness of the image that is finally printed, it is possible to add a water soluble resin or water soluble cross-linking agent to the reaction solution. That added material is not limited as long as it can coexist with the reaction component. It is preferable to add PVA or PVP as a water soluble resin, and from the aspect of stability of the reaction solution, it is preferable to add an oxazoline or carbodiimide, which has slow reactivity, as a water soluble cross-linking agent.

The method of applying the reaction solution is not particularly limited; however, employing a contact-type application device 3 as shown in FIG. 1 is preferred from the aspect of continuous production of printed material, and cost. What is referred to here as "contact-type" is a type in which after an excessive amount of reaction solution (fluid) 4 is once brought into contact with the belt (intermediate transfer member) 1, the excess reaction solution 4 is removed from the belt 1 so that only a desired amount of reaction solution 4 remains on the belt 1. It is possible to use wire bar coating, gravure offset roll coating, or spin coating, for example, as this kind of application method. In addition, a suitable combination of these methods could be used.

With this kind of apparatus, as will be described later, the amount of reaction solution applied to the surface of the belt (intermediate transfer member) 1 changes in connection with the change in the surface characteristics of the belt 1. In other words, in this embodiment, the amount of reaction solution supplied from the application roller 3C that comes in contact with the belt 1 increases or decreases depending on the surface characteristics of the surface layer 2. The change in surface characteristics are changes in the water repellency of the surface, changes in the amount of matter that adheres to the surface, changes in the physical roughness of the surface, and the like. As the belt 1 is used, for example, when the surface treated surface layer degrades and the hydrophilic characteristic decreases and the water repellency increases, the amount of reaction solution applied decreases. Moreover, as the belt 1 is used, when the water repellency decreases and the amount of matter adhering to the surface increases and the amount of surface roughness increases, the amount of reaction solution applied increases. Therefore, by detecting the amount of reaction solution applied to the surface layer 2, it is possible to know what changes are occurring to the surface characteristics of the belt 1. In addition, a reaction component is included in the reaction solution at a specified ratio, so that the change in the amount of reaction solution applied corresponds to the change in the amount of the reaction component applied (amount of reaction component). Therefore, by detecting the amount of reaction component on the belt 1, it is also possible to know what changes are occurring to the surface characteristics of the belt 1.

When the surface characteristics of the belt 1 change and the amount of reaction solution applied decreases or increases outside of a specified range, it is not possible to adequately achieve the initial function of the reaction solution, so that the printed image that is printed on the printing medium changes and it becomes easy for distortion to occur. Therefore, as will be explained later, by knowing what kind of changes are occurring to the surface characteristics of the belt 1 based on the amount of reaction solution applied or the amount of reaction component, it is possible to detect symptoms of a change in the state of the printed image before the amount of distortion of the image can no longer be ignored. More specifically, when the detected amount of reaction solution applied or the detected amount of reaction component decreases or increases and exceeds a specified threshold value, it is possible to determine that as a symptom of change in the state of the printed image.

An ink image (mirror inversion image with respect to the printed image on the printing medium) is formed on the surface layer 2 by ink being ejected from an inkjet printing portion 5 onto the surface layer 2 that is coated with reaction solution 4 in this way. The printing portion 5 can form a colored ink image on the surface layer 2 by using a plurality of printing heads (inkjet ejection heads) 5A that are capable of ejecting different inks. The printing heads 5A are capable of ejecting ink by using ejection energy generating elements such as electrothermal transducers (heaters) or piezo elements. In the case of using electrothermal transducers, ink is caused to bubble by the generated heat, and by using that bubbling energy, ink can be ejected from ejection ports. Moreover, it is also possible to use something other than an inkjet ejection head as a method of forming an ink image as long as it is possible to apply ink to the intermediate transfer member and form an ink image.

The ink image formed on the surface layer 2 is transferred to a printing medium 6 by a pressure roller 7 pressing the printing medium 6 against the belt 1. The portion of the surface layer 2 after the ink image has been transferred to the printing medium 6 moves to the position of the application device 3 and is coated again with reaction solution 4. It is also possible to provide a device between the inkjet printing portion 5 and the pressure roller 7 for promoting the removal of moisture on the surface layer 2. Various devices such as fan means, depressurization means, or absorption material that is brought in contact with the surface layer 2 can be used as this device, also construction could be such that the intermediate transfer medium itself is heated. The device could also be a combination of these. It is also possible to have a fixing device that improves the fastness of the image by fixing the image that has been transferred to the printing medium 6, and a cleaning device for cleaning the corresponding portion on the surface layer 2 after the ink image has been transferred to the printing medium 6.

A measurement device 8 that is located between the application device 3 and the inkjet printing portion 5 measures the amount of reaction component of the reaction solution 4 applied to the surface layer 2. This measurement device 8 includes a reaction solution recovery unit 9, a reaction component amount measurement unit 10 and a computer 11. The recovery unit 9 recovers the reaction solution of the measurement portion on the surface layer 2, and sends that recovered reaction solution to the measurement unit 10. The measurement unit 10 measures the amount of that reaction solution (amount of reaction component) and stores the measurement value A in the computer 11. As will be described later, the computer 11 executes processing for setting the recycling period or replacement period for the belt (intermediate transfer medium) 1 based on the measurement value A. The computer 11 includes a CPU, ROM storing programs that the CPU executes, and RAM that used as a work area, and can also control the overall printing apparatus.

It is possible to use various typically methods as the method for measuring the amount of reaction component. For example, a method can be used in which first, the reaction solution is scraped away and recovered from a specified measurement position on the intermediate transfer member such as a belt 1, and this recovered solution is heated, the solvent is evaporated and removed, and the mass of the remaining reaction component is measured. After that, the mass of that reaction component is divided by the area on the intermediate transfer member from which the reaction solution was recovered to calculate the amount of reaction component per unit area. A method can also be used in which the recovered solution described above is diluted to a specified concentration, after which the light absorption is measured, and by applying that measurement value to a calibration curve, the amount of reaction component is similarly calculated. By setting the dilution factor and the calibration curve in advance according to the components and concentration of the reaction solution, it is not necessary to prepare them each time printing is performed, making it possible to quickly measure the amount of reaction component. It is also possible to measure the amount of reaction component by titration to measure the reaction component using a chemical reaction.

A typical measurement method can be used to measure the amount of reaction component, and particularly, the method of measuring the amount of reaction component based on the electric conductivity is convenient and is preferred from the aspect of size of the printing apparatus and cost. For example, by preparing a correspondence table beforehand of the recovered solution described above and the amount of reaction component, the amount of reaction component can be measured by comparing the electric conductivity of the measured recovered solution with that correspondence table. It is also possible to measure the electric conductivity of the reaction solution by bringing two electrodes that are separated by an extremely short specified distance in direct contact with the surface of the intermediate transfer member applied with reaction solution. The latter method may be a little less precise than the former method; however, there is no need to recover the reaction solution, so that measurement can be performed more conveniently. Furthermore, by setting measurement points at several locations on the intermediate transfer member, and measuring the amount of reaction component of the reaction solution applied at these measurement points, it is possible to find the distribution over the surface of the amount of reaction component on the intermediate transfer member.

The position for measuring the amount of reaction component on the intermediate transfer member can be within an area on the intermediate transfer member where the reaction solution is applied. For example, setting the position for measuring the amount of reaction component within an area such as on the ends of the intermediate transfer member where there is little effect on the formation of the ink image is preferred in that there is little effect on the final printed image when measuring the amount of reaction component at the same time that the printing work is being performed.

As will be described later, the computer 11 compares the measurement value A with a predetermined appropriate range r. The appropriate range r is a range between the lower limit value B1 and the upper limit value B2 of the amount of reaction solution where distortion of the printed image can, for all practical purposes, be ignored. The lower limit value B1 and upper limit value B2 do not necessarily have to be borderline values where the distortion in the image can just barely be ignored, and taking productivity of the printed material into consideration, can be values obtained by multiplying those borderline values by a safety factor.

As long as the measurement value A is within the appropriate range r, ink continues to be ejected from the inkjet printing portion 5, and the series of printing processes are repeated. As will be described later, during this series of printing processes, each time a specified unit image is transferred to the printing medium 6, a counter for the number of times n that printing has been performed is counted up, and that counted number of times n is stored in the computer 11. As will be described later, when the measurement value A is outside of the appropriate range r, and the number of times n is $n<\alpha$, the belt 1 is recycled by a recycling process device 12. The value $\alpha$ is a reference number of times that printing has been performed, and is used for determining from the number of times n whether or not it is necessary to recycle the belt 1. When the belt 1 is recycled, the number of times n is reset to 0.

The recycling process can be suitably selected according to the type of intermediate transfer member (including belt 1) and ink used. For example, the recycling process can be cleaning, polishing, surface coating, heating, UV irradiation, plasma treatment, corona treatment, ozone treatment, frame treatment and the like. These recycling processes can be performed after removing the intermediate transfer member from the printing apparatus, or can be performed automatically inside the printing apparatus. By restoring the surface of the intermediate transfer member to its preferred initial state by performing the recycling process, it is possible to once again perform high-quality image printing. In the present invention, the state of the intermediate transfer member can be restored to a good printing state by recycling before distortion of the printed image on the printing medium occurs, so it is possible to keep wasteful use of the printing medium such as paper to a minimum.

After the belt 1 has been recycled, the application device 3 again coats the belt 1 with reaction solution 4, then the measurement device 8 measures the amount of reaction component of that reaction solution, and as long as the measurement value A is within the appropriate range r the printing process is continued and repeated. However, when the measurement value A cannot be recovered within the appropriate range r, or when the measurement value A is outside the appropriate range r, and the number of times n is not $n<\alpha$, the computer 11 sends a signal prompting replacement of the belt 1, and stops the printing apparatus.

(Another Example of Construction of a Printing Apparatus)

Figure 2:
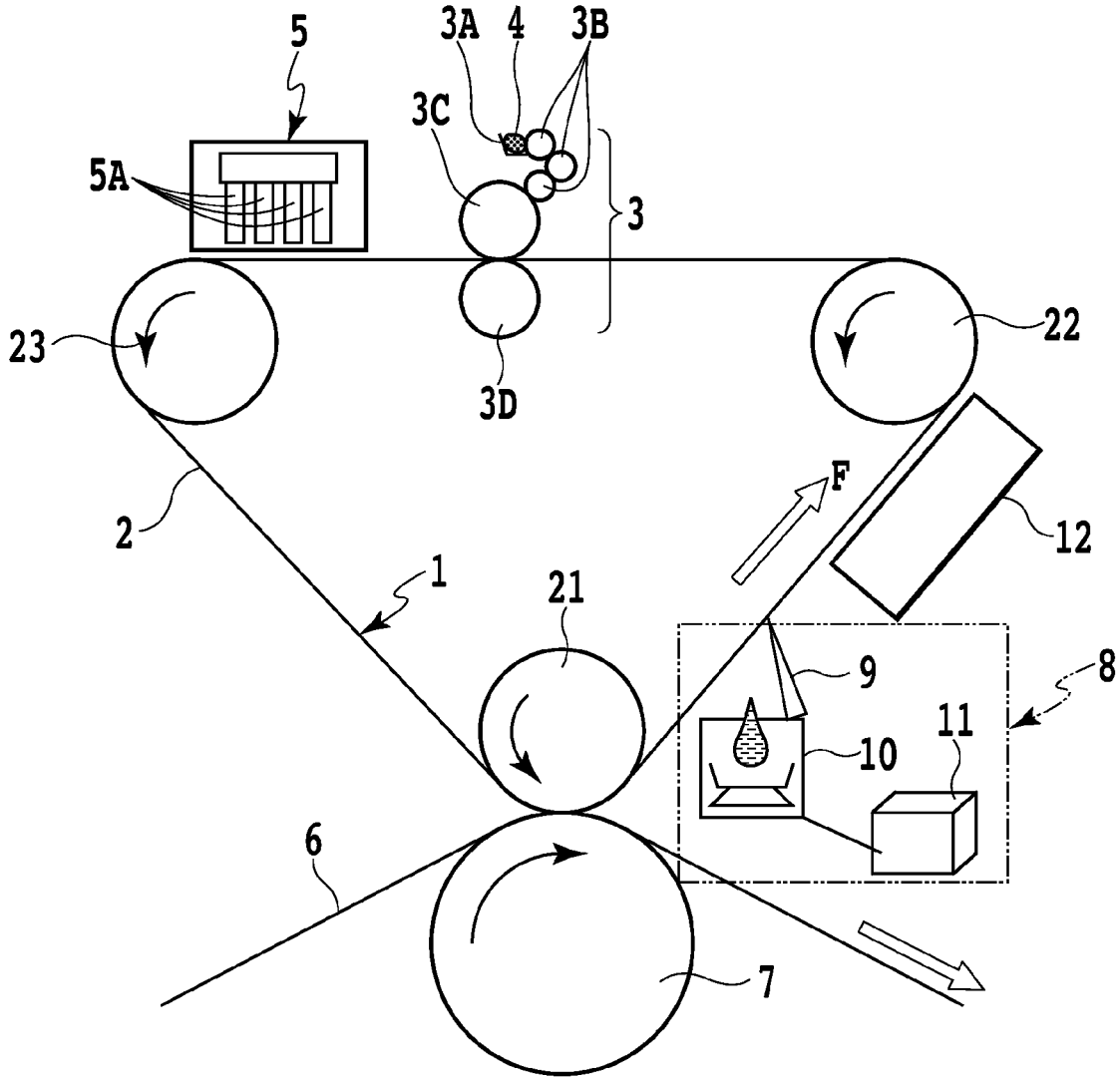
FIG. 2 is a schematic diagram for explaining the main parts of another example of the construction of the image printing apparatus of the present invention.

FIG. 2 is a schematic diagram for explaining the main parts of another example of the construction of a printing apparatus.

As illustrated in FIG. 2, the measurement device 8 for measuring the amount of reaction component may be provided between the pressure roller 7 and application device 3. In that case, as will be described later, after the application device 3 applies the reaction solution 4, the measurement device 8 measures the amount of reaction component without the inkjet printing portion 5 forming an ink image and the pressure roller 7 transferring the ink image to the printing medium 6. The method of measuring the amount of reaction component is the same as in FIG. 1. In the case of FIG. 2, the reaction solution recovery unit 9 can also function as the cleaning unit for the belt 1, so that is preferred from the aspect of the size of the printing apparatus and cost.

(Image Printing Method)

Figure 3:
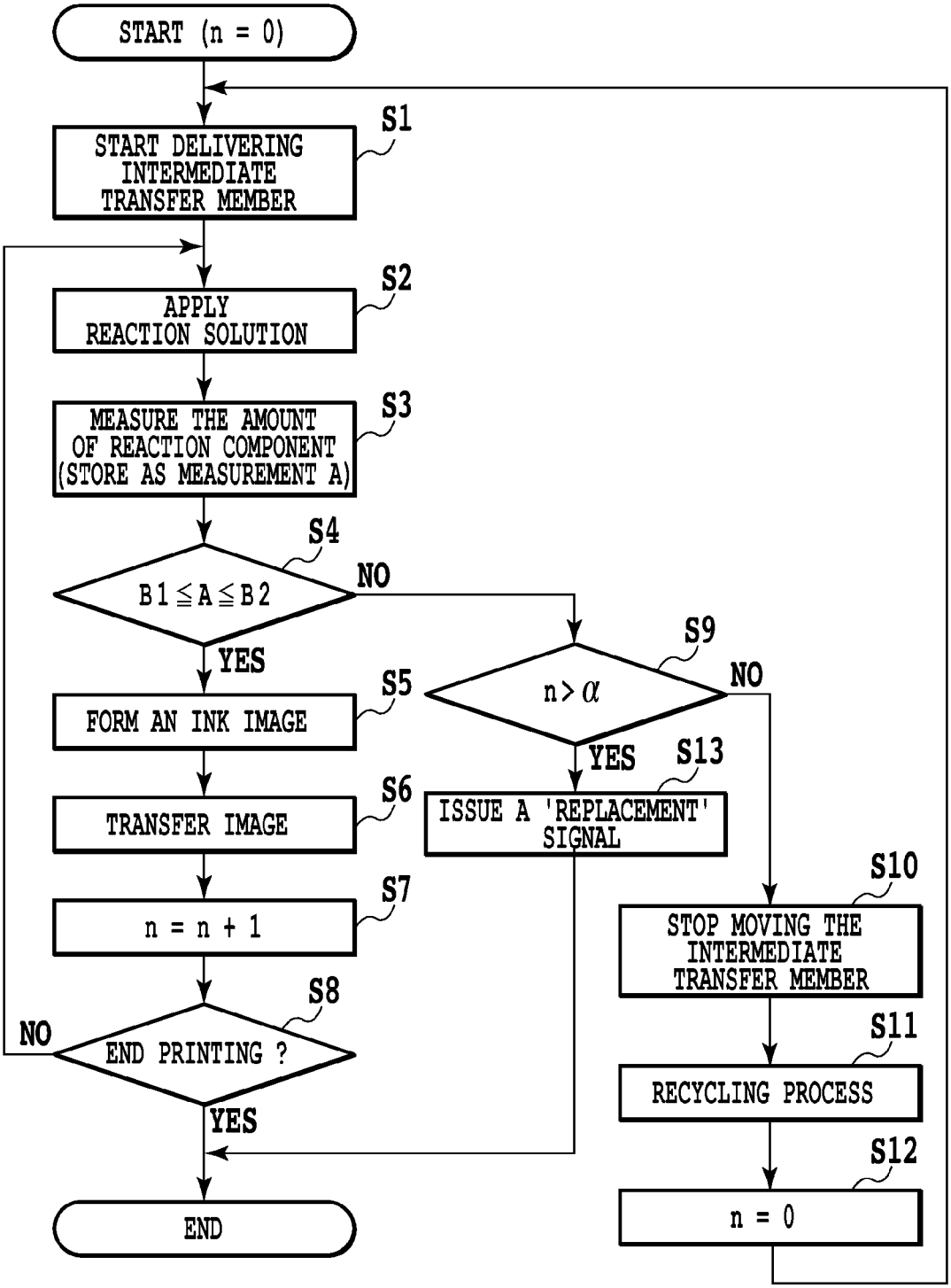
FIG. 3 is a flowchart for explaining the printing operation by the image printing apparatus of the present invention.

FIG. 3 is a flowchart for explaining an example of the image printing method of the present invention.

First, the printing apparatus is started, and movement of the belt 1 (intermediate transfer member) is started at a desired speed (step S1). Next, the application device 3 coats the surface layer 2 of the belt 1 with reaction solution 4 (step S2), after which the measurement device 8 measures the amount of reaction component and stores that measurement value in the computer 11 as measurement value A (step S3). The computer 11 compares the measurement value A with the lower limit value B1 and upper limit value B2 of the appropriate range r (step S4).

Figure 4:
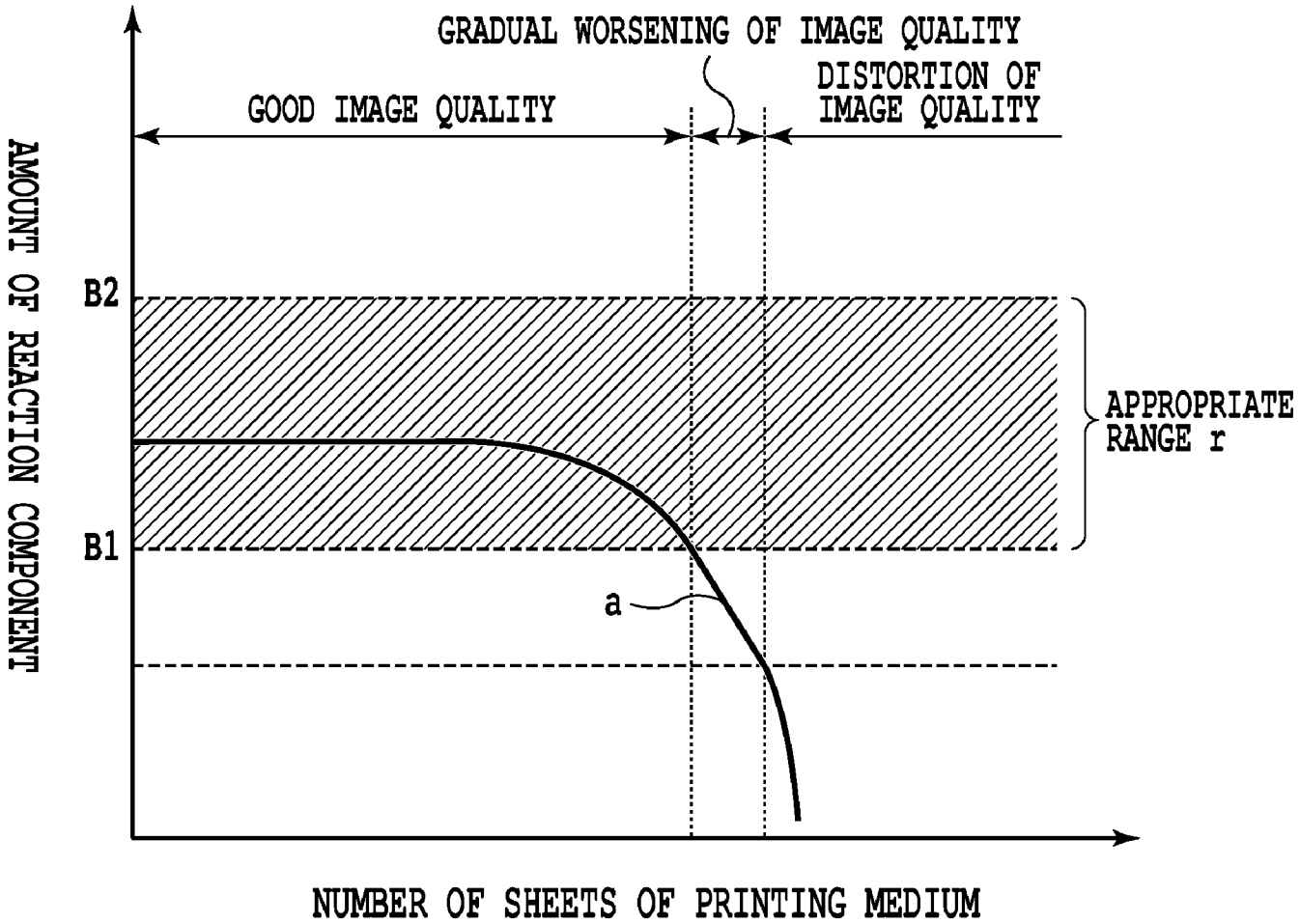
FIG. 4 is a diagram for explaining an example of the relationship of the number of printed sheets, amount of reaction component, and the image quality of the printed image.
Figure 5:
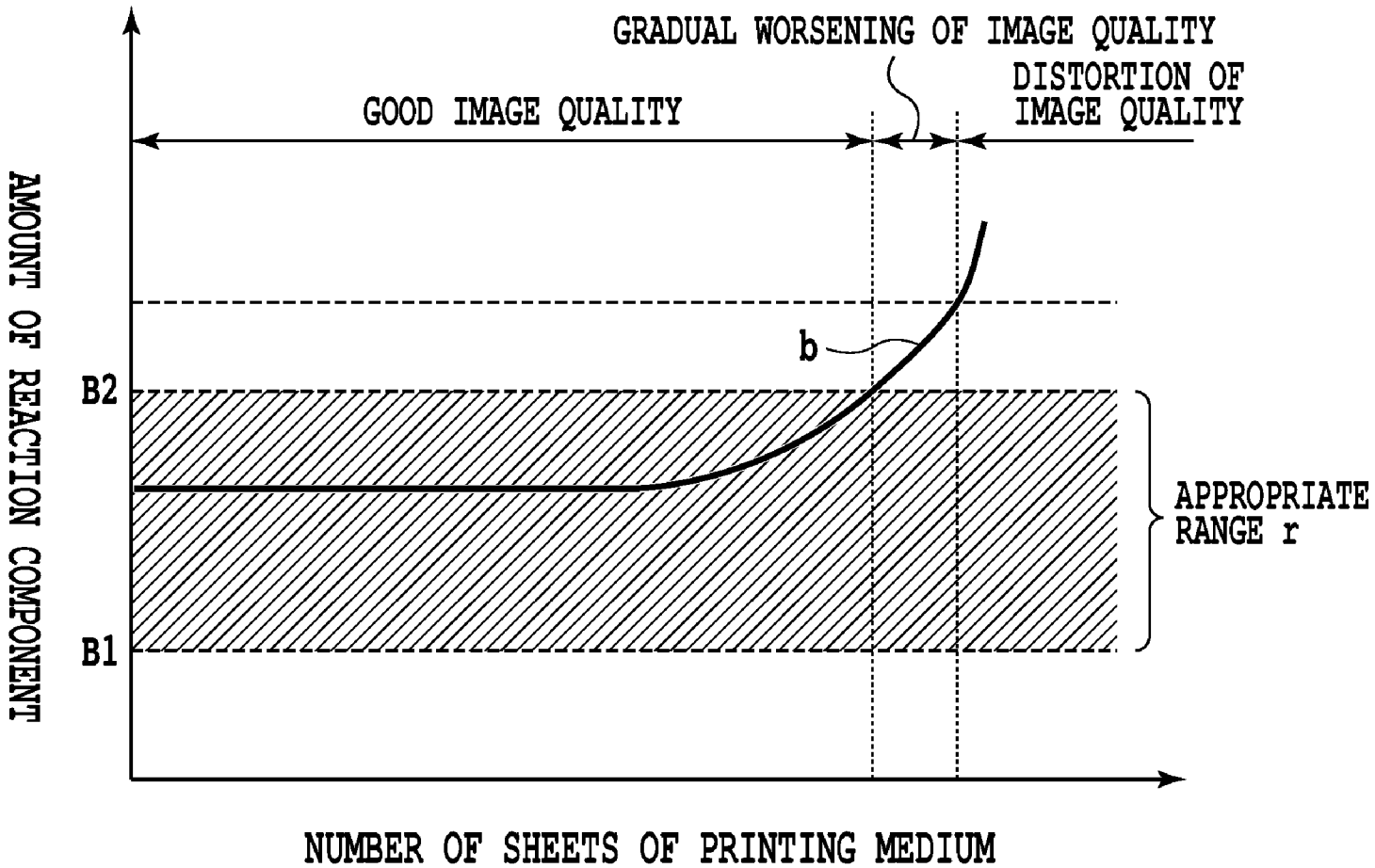
FIG. 5 is a diagram for explaining another example of the relationship of the number of printed sheets, amount of reaction component, and the image quality of the printed image.

Here, FIG. 4 and FIG. 5 will be used to explain the relationship between these values A, B1 and B2. FIG. 4 and FIG. 5 show examples of the relationship of the number of sheets of printing medium, the amount of reaction component, and whether or not the image quality of the printed image is good. The range between the lower limit value B1 and the upper limit value B2 is the appropriate range r.

FIG. 4 is an example of the case in which when continuously printing an image, the amount of reaction component gradually decreases. The curve "a" indicates the gradual decrease in the amount of reaction component as the number of printed sheets increases. For example, this kind of case is feasible when the water repellency of the surface of the intermediate transfer member increases as one of the surface characteristic of the intermediate transfer member (corresponds to the "surface layer 2 of the belt 1") that changes as the number of printing sheets increases. As illustrated in FIG. 4, distortion occurs in the ink image on the intermediate transfer medium that cannot be ignored when the amount of reaction component decreases and becomes less than a certain value. For example, when bleeding of the ink image occurs on the intermediate transfer medium before transfer due to a decrease in the amount of reaction component, that ink image is transferred to the printing medium, and as a result, distortion occurs in the printed image. In addition, there is a possibility that distortion of the image will occur in the transfer process of the ink image.

FIG. 5 is an example of the case in which the amount of reaction component gradually increases when continuously printing an image. The curve "b" indicates the gradual increase of the amount of reaction component as the number of printed sheets increases. For example, this case is feasible when the surface characteristic of the intermediate transfer member changes due to matter adhering to the surface of the intermediate transfer member or physical roughness of the surface of intermediate transfer member. In this case, distortion occurs in the ink image on the intermediate transfer member that cannot be ignored after the amount of reaction component increases and becomes greater than a certain value. For example, when beading occurs in the ink image before transfer due to the amount of reaction component on the intermediate transfer member being too excessive, that ink image is transferred to the printing medium, and as a result, distortion occurs in the printed image.

what should be noted in both of the cases illustrated in FIG. 4 and FIG. 5 is that a point at which the measurement value of the amount of reaction component changes and a point at which the distortion in the ink image on the intermediate transfer member will reach a level where it cannot be ignored are out of synchronization. In other words, the point at which the measurement value of the amount of reaction component will change always occurs before the point at which the distortion in the ink image on the intermediate transfer member will reach a level where it cannot be ignored. Therefore, by knowing the condition of the surface of the intermediate transfer member based on measurement values of the amount of reaction component, it is possible to prompt cleaning, recycling or replacement of the intermediate transfer member before distortion of the ink image on the intermediate transfer member occurs.

In step S4 in FIG. 3, the measurement value A of the amount of reaction component is compared with the predetermined lower limit value B1 and upper limit value B2 to determine whether or not the measurement value A is within the appropriate range r.

When the measurement value A is within the appropriate range r, processing advances to step S5, and in the inkjet ejection process by the inkjet printing portion 5, the inkjet printing portion 5 ejects ink onto the intermediate transfer member to which reaction solution has been applied and forms an ink image (mirror inverted image of the printed image on the printing medium). When doing this, as described above, the ink instantaneously reacts upon contact with the reaction component included in the reaction solution, and due to the decrease in fluidity of the color material, it is possible to suppress distortion of the ink image on the intermediate transfer member.

After that, in the transfer process, the ink image on the intermediate transfer member is transferred to the printing medium (step S6). In this transfer process, generally, the ink image is placed over the printing medium and pressure is applied, then the printing medium is peeled away. A typically used mechanism can be used as the mechanism for accomplishing this kind of transfer process. Particularly, from the aspect of productivity of printed material, and stability of the printed image, it is preferred to use a mechanism that uses the pressure roller 7 as illustrated in FIG. 1 and FIG. 2, and to apply pressure by way of the nip section of the two rollers.

After this kind of transfer process, the portion of the intermediate transfer member from which the ink image was delivered to the printing medium is moved to the position of the application process for applying reaction solution, then whether or not the number of printed units of printing media has reached a desired number is determined (step S8); with this series of processes described above being repeatedly executed until the number of printed units reaches the desired number. By doing so, it is possible to produce a desired number of printed materials. During the transfer process, it is also possible to store the number of transfer times in the computer, and by comparing that stored number of transfers with a set number that was input beforehand, the transfer process can automatically be repeated the necessary number of times. The number of transfer times can be the number of printing times for a specified unit of printing medium (for example, every specified number of printing medium, or every specified printing area).

As described above, in order to evaporate and remove the moisture or solvent component in the ink that forms the ink image on the intermediate transfer member, it is possible to provide a device for promoting the removal of moisture. In that case, the removal process for removing moisture performed by that device can be performed between the formation process of the ink image and the transfer process. In addition, as described above, it is possible to provide a fixing device for improving the fastness of the image that is transferred onto the printing medium, and a cleaning device for cleaning the surface of the intermediate transfer member. In that case, these devices can be used to perform a fixing process and a cleaning process.

When repeating the series of processes described above, when the measurement value A of the amount of reaction component is outside the appropriate range r, or in other words, when A<B1 or B2<A, the recycling process device 12 executes the recycling process for recycling the intermediate transfer member, or the process for replacing the intermediate transfer member. Determining whether to execute the recycling process or replacement process can be set according to an established operation sequence. This established operation sequence can be suitably set by the user. For example, this established operation sequence can be set so that the recycling process is executed while a frequency that the measurement value A deviates from the appropriate range r is low, and so that the replacement process is executed when that frequency becomes high, or in other words, when it becomes difficult for the recycling process to be effective.

In the example of FIG. 3, whether to execute the recycling process or the replacement process is determined by counting the number of execution times n of the transfer process for each intermediate transfer member, and comparing the number of times n in the case of the measurement value A has deviated from the appropriate range r with a specified number of times $\alpha$. The number of execution times n of the transfer process is counted up every time the ink image is transferred to a specified unit of printing medium (for example, after every specified number of printing medium, after every specified printing area, or after every specified number of times that the intermediate transfer member rotates). In other words, whether to perform the recycling process to recycle the intermediate transfer member or to perform the replacement process to replace the intermediate transfer member is set according to the printing status from the previously performed recycling process or replacement process. The specified number of times $\alpha$ is a predetermined threshold value that is set from both the durability of the intermediate transfer member and the production efficiency of the printed material. The number of times n that the measurement value A deviates from the appropriate range r is compared with the number of times $\alpha$ (step S9), and when $n<\alpha$, normal delivery of the intermediate transfer member stops and the recycling process is executed (steps S10, S11), after which the number of times n is reset (step S12).

The user of the printing apparatus can arbitrarily set the number of times $\alpha$. There are also cases in which the surface of the intermediate transfer member may not return to 100% the original state even though the recycling process is performed. In that case, even though the printing operation becomes possible by repeating the recycling process, each time the recycling process is repeated, the number of times n, that the transfer process can be executed before the measurement value A deviates from the appropriate range r, decreases. That is, each time the recycling process is repeated, the number of times n, that the intermediate transfer member can be used from the previous recycling process to the next recycling process, decreases. When that number of times n has decreased an extreme amount, the frequency at which the recycling process is executed becomes high, and causes a drop in productivity of the printed material. Therefore, in this example, when the number of times n exceeds the number of times α, a "replacement" signal is sent for prompting that replacement be performed (step S12). When this signal is sent, the user of the printing apparatus can improve productivity of the printed material by replacing the intermediate transfer member.

Moreover, it is possible to notify the "replacement" signal to the user of the printing apparatus when the number of times n exceeds the number of times α, and to stop delivery of the intermediate transfer member. In that case, the user can take measures such as automatically sending a service call to the customer service center. Also, when the user replaces the intermediate transfer member, the number of times n is reset to 0.

Furthermore, when the measurement value A of the amount of reaction component is outside the appropriate range r, or in other words, when A<B1 or B2<A, it is possible to notify the user of that comparison result, and for the user to select whether to execute the recycling process for recycling the intermediate transfer member or to execute the replacement process. In addition, depending on the comparison result, it is possible to notify the user of the time when the recycling process or replacement process of the intermediate transfer member should be executed.

Moreover, when the amount of reaction component is measured immediately after executing the recycling process and the measurement value A is not restored within the appropriate range r, it is possible to repeat the recycling process. It is also possible to include a sequence of changing to the replacement process when the measurement value A is not restored to within the appropriate range r even though the recycling process has been performed a specified number of times. Depending on the cost, performance, and operation method of the intermediate transfer member, it is also possible to immediately perform the replacement process and not the recycling process when the measurement value A of the amount of reaction component is outside the appropriate range r.

Furthermore, in the example of FIG. 3, the amount of reaction component is measured every time the printing process (transfer process) is performed, however, measurement of the amount of reaction component could also be performed every time the printing process has been performed a few times, or every time the printing process has been performed several tens of times. It is also possible to include a measurement sequence for measuring the amount of reaction component as necessary during the printing process. As an example of the measurement sequence could be a sequence of a recovery device recovering reaction solution from the intermediate transfer member without forming or transferring an ink image after reaction solution has been applied to the intermediate transfer member. In that case, it is possible to perform more accurate measurement by increasing the measurement area for measuring the amount of reaction component on the intermediate transfer member. It is also possible to perform more accurate measurement by increasing the number of locations on the intermediate transfer member for measuring the amount of reaction component, and by taking the average of those measurements. Moreover, when there is a cleaning process for cleaning the intermediate transfer member, that cleaning process can be performed with the recovery process for recovering reaction solution, which is preferred from aspect of size and cost of the printing apparatus. The frequency that the measurement sequence is executed can be suitably set according to the range and conditions in which the productivity of the printed material is not hurt.

As described above, there are various phenomena that occur as the intermediate transfer member degrades depending on the material used for the intermediate transfer member, the method for treating the surface, and the composition of the reaction solution. In this embodiment, both the upper limit value and lower limit value were set as threshold values when detecting the amount of reaction solution on the surface of the intermediate transfer member, however, it is also possible to have just one of the two. For example, when surface treatment has been performed so that the surface is water repelling, it is possible to use just the upper limit value, and when the detected reaction solution exceeds a specified amount, perform the recycling process or replacement process. Also, when surface treatment has been performed to so that the surface is water attracting, it is possible to use just the lower limit value, and when the detected reaction solution is a specified amount or less, perform the recycling process or replacement process.

(Ink Composition)

The ink used is not particularly limited, however, typical water-based ink that uses dye or pigment can be suitably used. Particularly, when using metallic salt in the reaction solution, a water-based pigment ink is preferable.

The dye used is not limited, and it is possible to use a typically used dye without problem. As the dye it is possible to use, for example: C.I. direct blue 6, 8, 22, 34, 70, 71, 76, 78, 86, 142 and 199; C.I. acid blue 9, 22, 40, 59, 93, 102, 104, 117, 120, 167 and 229; C.I. direct red 1, 4, 17, 28, 83 and 227; C.I. acid red 1, 4, 8, 13, 14, 15, 18, 21, 26, 35, 37, 249, 257 and 289; C.I. direct yellow 12, 24, 26, 86, 98, 132 and 142; C.I. acid yellow 1, 3, 4, 7, 11, 12, 13, 14, 19, 23, 25, 34, 44 and 71; C.I. food black 1 and 2; and C.I. acid black 2, 7, 24, 26, 31, 52, 112 and 118.

The pigment used is not limited, and it is possible to use a typically used die with no problem. As the pigment it is possible to use, for example: C.I. pigment blue 1, 2, 3, 15:3, 16 and 22; C.I. pigment red 5, 7, 12, 48 (Ca), 48 (Mn), 57 (Ca), 112 and 122; C.I. pigment yellow 1, 2, 3, 13, 16 and 83; carbon black No. 2300, 900, 33, 40, 52; MA7, 8; MCF88 (Mitsubishi Chemical); RAVEN 1255 (Columbia); REGAL 330R, 660R; MOGUL (Cabot); Color Black FW1, FW18, S170 and S150; and Printex 35 (Degussa).

The form of these pigments is not limited, and for example, the pigment can be self-dispersing type, resin dispersing type, micro capsule type and the like. As the pigment dispersing agent, it is preferable to use a dispersing resin that is water soluble and has a weight-average molecular weight of 1,000 to 15,000. More specifically, it is possible to use, for example, block copolymers or random copolymers comprising styrene and dielectrics thereof, vinylnaphthalene and dielectrics thereof, α, β-ethylene unsaturated carboxylic acid aliphatic alcohol ester, acrylic acid and dielectrics thereof, maleic acid and dielectrics thereof, itaconic acid and dielectrics thereof, fumaric acid and dielectrics thereof, or salts of these.

Moreover, in order to improve the fastness of the image that is finally printed on the printing medium, it is possible to add a water soluble resin or water soluble cross-linking agent. These materials are not limited as long as they can coexist with the ink components. It is preferred to further add the above dispersing resin or the like to the water soluble resin. From the aspect of ink stability, it is preferred that slow reacting oxazoline or carbodiimide be used as the water soluble cross-linking agent.

In order to control the ejection performance for ejecting ink from the printing head, and drying of the ink, it is possible to add a nonaqueous solvent to the ink. Particularly, the transfer of an ink image from the intermediate transfer member to the printing medium is greatly affected by the drying state of that ink image, so it is important that a suitable added solvent be used. It is preferred that a water soluble material having low vapor pressure at a high boiling point be used as the nonaqueous solvent. For example, it is possible to use polyethylene glycol, polypropylene glycol, ethylene glycol, propylene glycol, butylene glycol, triethylene glycol, thiodiglycol, hexylene glycol, diethylene glycol, ethylene glycol monomethyl ether, diethylene glyco monomethyl ether, and glycerin. In addition, it is possible to suitably use an alcohol such as ethyl alcohol or isopropyl alcohol and various kinds of surface acting agents as components for adjusting the viscosity and surface tension of the ink, and improving the ejection performance.

The compound ratio of the components of the ink is not limited, and can be suitably adjusted according to the performance and construction of the inkjet ejection apparatus used, and more specifically according to the ejecting force and diameter of the ejection nozzle. An example of the ink composition is 0.1 to 10% coloring material, 0.1 to 10% dispersing resin, 5 to 40% nonaqueous solvent, 0.1 to 5% surface acting agent, and the remaining pure water.

An example of the invention and a comparative example will be given below, in order to explain the invention in more detail. Of course the present invention is not limited to the following example. In the explanation below, the terms "parts" and "%" unless specified otherwise, refer to mass standards.

Example 1

As the base material for the surface layer of the intermediate transfer member, a 0.4 mm PET film surface coated with a 0.2 mm thick silicone rubber (Shinetsu Chemical Co., KE12) having a rubber hardness of 40° was used. A regular pattern comprising a lyophilic section and a fluid repelling section is formed on the surface of this surface layer base material by the following procedure.

First, using a parallel plate type air pressure plasma treatment device (Sekisui Chemical Co.,: APT-203), a surface lyophilic treatment was performed on the surface of the surface layer base material, after which 3% PVA aqueous solution (Kuraray Co.: 403) was coated over the entire surface using a roll coater and allowed to dry. After that, the surface was spot irradiated by an excimer laser to remove the PVA layer from the portion of the surface that will be the lyophilic section. In this example, patterning was performed regularly with circles having a 4 μm diameter and an 8 μm pitch. After that, using the parallel plate type plasma treatment device again, the surface modification was performed on the surface of the surface layer base material under the following conditions.

(Surface Modification Conditions)

Gas used, flow rate: Air, 1000 cc/min

N2, 6000 cc/min

Input voltage: 230 V

Frequency: 10 kHz

Processing speed: 200 mm/min

Next, the surface of this surface layer base material was cleaned using a surface acting agent (Nihon Unicar; Silwet L77) 7% aqueous solution. When doing this, the PVA layer, which is a water soluble film, is dissolved and removed. The surface layer base material manufactured in such a way is such that only the portion cleaned and processed by the excimer laser becomes the lyophilic section, and a desired pattern having a lyophilic section and water repellent section is obtained on the surface.

In this example, in order to form a belt type intermediate transfer member as illustrated in FIG. 1 and FIG. 2, a belt made of nonwoven fabric and impregnated with urethane resin is used as the support material of the intermediate transfer member, and the surface layer base material is applied and fastened to this support material. The surface of the surface layer base material corresponds to the surface layer 2 of the belt 1 (intermediate transfer member) in FIG. 1 and FIG. 2.

Next, using a roll coater (application device) as illustrated in FIG. 1 and FIG. 2, reaction solution having the composition described below was applied to the intermediate transfer member. The reaction component of that reaction solution is a calcium chloride dihydrate $CaCl_2.2H_2O$.

(Reaction Solution Composition)

$CaCl_2.2H_2O$: 30%

Surface acting agent (Kawaken Fine Chemicals Co., Ltd.; Acetylenol EH): 1%

Diethylene glycol: 30%

Pure water: 39%

Next, as illustrated in FIG. 1, the amount of reaction component of the reaction solution was measured using the measurement device that is provided between the roll coater (application device) and the inkjet printing portion. The measurement device used in this example includes: a squeegee, a solution recovery cell with heater, a crystal oscillator type weight sensor, computer, and a sponge containing water for cleaning the inside of the solution recovery cell with heater. The crystal oscillator type weight sensor is installed in the solution recovery cell with heater, and measures in real-time the change in weight of that cell, then transfers the measurement value in real-time to the computer.

Of the reaction solution applied to the intermediate transfer member, the reaction solution in a 2 cm×2 cm portion on the intermediate transfer member separated 2 cm from the end of the area on the intermediate transfer member where an ink image can be formed (ink image formation section) was scraped and removed by the squeegee. The reaction solution that was removed was recovered into the recovery cell with heater, and was instantaneously heated and dried, after which the weight was measured by the crystal oscillator type weight sensor. That measured value Ma was then transferred to the computer. The difference (Ma−Mb) between that measurement value Ma and the weight Mb of the solution recovery cell with heater before recovering the reaction solution was calculated, and that was taken to be the measurement value A of the amount of reaction component. In this example, A=0.2 $g/m^2$. This measurement value A was within a predetermined appropriate range r ($0.1\ g/m^2 < r < 2\ g/m^2$), so continuing the inkjet printing portion formed an ink image.

The inkjet printing portion (nozzle array density: 1200 dpi, ink ejection amount: 4.8 pl) formed an mirror inversed ink image on the intermediate transfer member coated with reaction solution. Here, ink (four colors of ink that include pigment for each color as color material) having the following composition was used.

(Ink Formula)

| | |
|---|---|
| Following pigment material: | 3 parts |
| Black: Carbon black (Mitsubishi Chemical Co.: MCF88) | |
| Cyan: Pigment blue 15 | |
| Magenta: Pigment red 7 | |
| Yellow: Pigment yellow 74 | |

-continued

| | |
|---|---|
| Styrene - acrylic acid - ethyl acrylate copolymer (Acid number 240, Weight-average molecular weight 5000) | 1 part |
| Glycerin: | 10 parts |
| Ethylene glycol: | 5 parts |
| Surface acting agent: (Kawaken Fine Chemicals Co.: Acetylenol EH) | 1 part |
| Ion-exchange water: | 80 parts |

At the instant that the ink image was formed on the intermediate transfer member, neither beading or bleeding occurred. In addition, when the ink drops ejected from the inkjet printing portion came in contact with the intermediate transfer member, the diameter of the ink dots (ink impact diameter) formed on the intermediate transfer member was approximately 40 μm.

Moreover, after the moisture was removed from the ink image formed on the intermediate transfer member and the fluidity of the ink decreased, a pressure roller brought the printing medium (Nippon Paper Group, Inc., Aurora Coat, ream weight 40.5) in contact with the intermediate transfer member, and transferred the ink image to the printing medium. As a result, it was confirmed that a high-quality image was printed on the printing medium. After transfer, hardly any remaining ink could be seen on the surface of the intermediate transfer member.

This series of printing process was continuously repeated, and the amount of reaction component was measured at a ratio of one time per 10 rotations of the intermediate transfer member. Also, taking the measured amount of reaction component to be the measurement value A, the change in the amount of reaction component on the intermediate transfer member was monitored by comparing measurement value A with the appropriate range r again. One time in ten measurements of the amount of reaction component, the inside of the recovery cell with heater was cleaned with the water containing sponge, after which the heater was heated to sufficiently remove the moisture inside the cell. By doing so, the reaction component was prevented from adhering to or accumulating inside the cell, and the weight of the cell was kept from exceeding the measurement limit of the weight sensor when measuring the reaction component.

In this example, with the number of printed units of printing media taken to be 1,000 sheets, the change in the amount of reaction component was monitored by measuring the amount of reaction component 100 times. As a result, the measurement values A were all within the appropriate range r ($0.1\ g/m^2<r<1\ g/m^2$). Moreover, all of the images printed on the printing medium were good with no distortion.

Example 2

In this example, except for increasing the number of printed units of printing media to 5,000 sheets, all of the other conditions were the same as in example 1.

At the point where the number of printed units of printing medium exceeded 1,600 sheets, the measurement value A gradually began decreasing. Also, when the number of printed units of printing medium reached 2,100 sheets, the measurement value A became 0.13, however, the percentage of printed materials (printing medium on which an image is printed) having distortion of the printed image was 0.5% or less. Printing was further repeated, and when the number of printed units of printing media reached 2,230 sheets, the measurement value A was nearly the same as the lower limit value 0.1 of the appropriate range r. At this time, the percentage of printed materials having distortion of the image thought to be due to bleeding in part of the image was about 2%. The intermediate transfer member (belt) was removed at that time, and a parallel plate type plasma treatment device was used to perform surface modification of the surface of the intermediate transfer member with the conditions being as described below.

(Surface Modification Conditions)

Gas used, flow rate: Air, 1000 cc/min $N_2$, 6000 cc/min

Input voltage: 230 V

Frequency: 10 kHz

Processing speed: 200 mm/min

After that, the intermediate transfer member (belt) that was surface modified in this way was mounted again in the printing apparatus, and the printing operation was executed under the same conditions as in Example 1. Immediately after the printing operation was started again, a good image was obtained with no distortion in the printed image. At the point of exceeding 1,200 sheets of printing medium after restarting the printing operation, the measurement value A began to decrease, however, no distortion could be seen in the printed image. The number of printed units of printing media was further increased, and when the number reached 1,540 sheets, the measurement value A was nearly the same as the lower limit value 0.1. This time, the percentage of printed materials having distortion of the printed image thought to be due to bleeding was about 1.4%.

At this time, the intermediate transfer member (belt) was removed again, and surface modification was performed by irradiating the surface of the intermediate transfer member with plasma under the same conditions as before. The surface modified intermediate transfer member (belt) was mounted in the printing apparatus again, and after restarting the printing operation, a good image was obtained with no distortion in the printed image. The printing operation was continued, and when the number of printed units of printing media reached 230 sheets after restarting the printing operation, or in other words, when the total number of printed units of printing media reached 5,000 sheets, printing was ended.

Example 3

In this example, instead of calculating the amount of reaction component by measuring the weight as was done in example 1 described above, the measurement device for measuring the amount of reaction component calculated the amount of reaction component by measuring the electric conductivity. All of the other conditions were the same as in example 1 described above.

The measurement device for measuring the amount of reaction component includes a squeegee, a solution recovery cell, a diluent ion-exchange water cell, an electric conductivity meter (Horiba Ltd., Model DS-52, 3562-10D), and a computer. The squeegee is the same as used in the examples described above. The solution recovery cell and diluent ion-exchange water cell are connected by a tube, and similarly, the solution recovery cell and electric conductivity meter are connected by a tube.

As in Example 1, part of the reaction solution applied to the intermediate transfer member is recovered into the solution recovery cell by the squeegee, then ion-exchange water is put into the recovered solution from the diluent ion-exchange water cell at 4 times the amount in weight, to dilute the reaction solution. This diluted reaction solution is passed through the tube to the measurement cell of the electric conductivity meter, where the electric conductivity is measured, and that electric conductivity and the measurement temperature is sent as data to the computer. From that data, the computer calculates the amount of calcium chloride dihydrate, and takes that result to be the measurement value A of the amount of reaction component. In this example, the measurement temperature was always 24.0° C., and the measurement value A was 0.20 g/m$^2$. This measurement value A was within the appropriate range r, so that the printing operation was performed in the same was as in example 1.

Moreover, as in example 1, the number of printed units of printing media was taken to be 1,000 sheets, and the change in the amount of reaction component on the intermediate transfer member was monitored by measuring the amount of reaction component 100 times. As a result, the measurement value A was within the appropriate range r (0.1 g/m$^2$<r<1 g/m$^2$), and all of the printed images on the printing medium were good with no distortion.

Example 4

In this example, as illustrated in FIG. 2, the measurement device for measuring the amount of reaction component is provided between the transfer portion and the roll coater (application device), and that measurement device was used as a cleaning mechanism for cleaning the intermediate transfer member. Other than this, this example is the same as example 3 described above.

In this example, first, the roll coater (application device) was used to apply reaction solution to the intermediate transfer member (belt), and the intermediate transfer member was delivered without forming or transferring an ink image. The measurement device measured the amount of reaction component of the reaction solution on that intermediate transfer member and calculated the measurement value A of the amount of reaction component. In this example, the measurement value A was 0.21 g/m$^2$ and was within the predetermined appropriate range r (0.1 g/m$^2$<r<2 g/m$^2$), so the printing operation was started. In other words, as in example 3, after the reaction solution was applied to the intermediate transfer member, the inkjet printing portion formed a mirror inverted ink image on the intermediate transfer member that was coated with the reaction solution, and that ink image was transferred to the printing medium. The printing operation was performed one time as the intermediate transfer member rotated one time, and after every time the printing operation was performed 10 times, the measurement device measured the amount of reaction component and calculated the measurement value A.

After the transfer in the printing operation was performed 100 times, the surface of the intermediate transfer member was cleaned. In that cleaning, the squeegee of the reaction component measurement device was used to scrape away any adhering matter from the entire surface of the intermediate transfer member. Furthermore, after an amount of only 0.1 g/m$^2$ of the diluent ion-exchange water of the measurement device was applied to the intermediate transfer member (for example, applied by dripping), it was scraped away using the squeegee. The recovered solution removed in this way was recovered to a waste solution tank as waste solution. After this kind of cleaning, no remaining ink or reaction solution and no matter such as dirt, paper dust and the like could be seen adhering to the intermediate transfer member, and the surface was extremely clean.

After that, the amount of reaction component was measured again, and the measurement value A was calculated. That measurement value A was 0.20 g/m$^2$. This measurement value A was within the appropriate range r, so the printing operation was performed as in example 1. The number of printed units of printing media was taken to be 1,000 sheets, and during the printing operation, the amount of reaction component was measured 100 times, cleaning was performed 10 times, and the change in the amount of reaction component on the intermediate transfer member was monitored. As a result, all of the measurement values A were within the appropriate range r (0.1 g/m$^2$<r<1 g/m$^2$), and the images transferred to the printing medium were all good with no distortion.

Comparative Example

As a comparative example, printing was performed under the same conditions as example 2 up to approximately 5,000 sheets of printing medium without measuring the amount of reaction component on the intermediate transfer member. Determination of whether or not there was distortion in the printed image was performed visually for a sampling of the printed images. A certain amount of time was required to determine whether or not there was distortion in the printed images, so in this sampling inspection, sampling was performed 1 time for 100 printing sheets for printing medium instead of the 1 time for 10 printing sheets as in example 1.

During the inspection, when the number of printed units of printing media reached 2,000 sheets, there was a little distortion of the printed image thought to be due to bleeding, so that the inspection was performed again when the number of printed units of printing media reached 2,050 sheets. However, in that inspection, the printed image was good with no distortion, so the printing operation was continued. When the number of printed units of printing media reached 2,500 sheets, again there was distortion of the printed image thought to be due to bleeding, so the inspection was performed again when the number of printed units of printing media reached 2,550 sheets. Similar distortion was also confirmed at that time as well, so at that point the printing operation was ended. After this printing operation, upon inspecting the printed materials, at 2,300 printing sheets of printing medium and beyond, there was distortion of the printed image in approximately 70% of the printed materials, and of the printed materials after 2,370 sheets, there was distortion in most of the images, so the printing operation was useless.

Therefore, the intermediate transfer member (belt) was removed and surface modification was performed by irradiating the surface of the intermediate transfer member with plasma under the same conditions as in example 2.

After that, the intermediate transfer member was again mounted in the printing apparatus, and the printing operation was performed under the same conditions as in example 1. Immediately after the printing operation was restarted, a good image was obtained with no distortion in the printed image. When the number of printed units of printing media reached 1,700 sheets after the printing operation was restarted, there was a little distortion in the image, so the inspection was performed at 1,750 sheets. However, at the time the image was good with no distortion, so the printing operation was continued. After that, when the number of printed units of printing media reached 2,000 sheets, there was distortion in the image, so the inspection was performed at 2,050 sheets. At that time, that same image distortion was confirmed, so at that point the printing operation was ended. After this printing operation, upon inspecting the printed materials, at 1,750 sheets of printing medium and beyond, and particularly at 1,850 sheets and beyond, about 50% of the images had distortion and were useless.

Therefore, the intermediate transfer member (belt) was removed again, and again surface modification was performed by irradiating the surface of the intermediate transfer member with plasma.

After that, the intermediate transfer member was mounted in the printing apparatus again, and the printing operation was performed under the same conditions as in example 1. Immediately after the printing operation was started again, a good image was obtained with no distortion. When the number of printed units of printing media reached 2,500 sheets after the printing operation was restarted, the total number of printed units of printing media was 5,000, so the printing operation was ended. Of the 5,000 sheets of printed material, there was image distortion in more than 300 sheets.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2009-172438, filed Jul. 23, 2009, 2010-130167, filed Jun. 7, 2010, which are hereby incorporated by reference herein in their entirety.

What is claimed is:

1. A printing apparatus having an image formation unit that forms an ink image on a surface of an intermediate transfer member, and a transfer unit that transfers the ink image formed on the intermediate transfer member to a printing medium, comprising:

an application unit configured to apply reaction solution reacting with ink to the surface of the intermediate transfer member;

a detection unit configured to detect an application amount of the reaction solution applied to the surface of the intermediate transfer member by the application unit; and a notification unit configured to give notification of a comparison result when the application amount of the reaction solution detected by the detection unit is compared with a specified threshold value.

2. The printing apparatus according to claim 1, wherein the application unit applies the reaction solution to the surface of the intermediate transfer member in a manner that after an excessive amount of the reaction solution is brought into contact with the surface of the intermediate transfer member, the excessive amount of the reaction solution is removed.

3. The printing apparatus according to claim 1, wherein the detection unit detects the application amount of the reaction solution per unit area of the surface of the intermediate transfer member.

4. The printing apparatus according to claim 1, wherein the reaction solution includes a reaction component that decreases fluidity of a coloring material in the ink.

5. The printing apparatus according to claim 1, wherein the reaction solution includes a reaction component reacting with the ink, and the detection unit detects an amount of the reaction component in the reaction solution applied to the surface of the intermediate transfer member as the application amount of the reaction solution.

6. The printing apparatus according to claim 5, wherein the detection unit detects the amount of the reaction component according to electric conductivity thereof.

7. The printing apparatus according to claim 1, wherein the notification unit gives notification of at least one of a period for performing a recycling process and a period for performing a replacement process for the intermediate transfer member based on the comparison result.

8. The printing apparatus according to claim 7, wherein the notification unit gives notification of at least one of the period for performing the recycling process and the period for performing the replacement process for the intermediate transfer member based on at least one of the number of printed sheets of the printing medium, a printing area, and the number of rotations of the intermediate transfer member since the previous recycling process or the previous replacement process of the intermediate transfer member.

9. The printing apparatus according to claim 1, further comprising:

an inkjet printing portion for forming an ink image on the surface of the intermediate transfer member by using an inkjet printing head capable of ejecting ink.

10. A printing apparatus having an image formation unit that forms an ink image on a surface of an intermediate transfer member, and a transfer unit that transfers the ink image formed on the intermediate transfer member to a printing medium, comprising:

an application unit configured to apply reaction solution reacting with ink to the surface of the intermediate transfer member;

a detection unit configured to detect an application amount of the reaction solution applied to the surface of the intermediate transfer member by the application unit; and an execution unit configured to execute at least one of a recycling process for the intermediate transfer member and giving notification of a replacement process for the intermediate transfer member, based on a comparison result when the application amount of the reaction solution detected by the detection unit is compared with a specified threshold value.

11. A control method for controlling a printing apparatus having an image formation unit that forms an ink image on a surface of an intermediate transfer member, and a transfer unit that transfers the ink image formed on the intermediate transfer member to a printing medium, comprising the steps of:

applying reaction solution reacting with ink to the surface of the intermediate transfer member;

detecting an application amount of the reaction solution applied to the surface of the intermediate transfer member; and giving notification of a comparison result when the detected application amount of the reaction solution is compared with a specified threshold value.

12. The control method according to claim 11, further comprising the step of:

giving notification of at least one of a period for performing a recycling process and a period for performing a replacement process for the intermediate transfer member based on the comparison result.

13. The control method according to claim 11, wherein the image formation unit forms the ink image on the surface of the intermediate transfer member by using an inkjet printing head capable of ejecting ink.

* * * * *